US005363734A

United States Patent [19]

Wilenken

[11] Patent Number: 5,363,734

[45] Date of Patent: Nov. 15, 1994

[54] GUITAR HOLSTER

[76] Inventor: Stephen P. Wilenken, 1112 W. Porter, Apt. 4, Fullerton, Calif. 92633

[21] Appl. No.: 87,987

[22] Filed: Jul. 1, 1993

[51] Int. Cl.[5] ..... G10D 3/00

[52] U.S. Cl. ..... 84/327; 248/309.1

[58] Field of Search ..... 84/280, 327; 248/309.1, 248/683, 690

[56] References Cited

U.S. PATENT DOCUMENTS

| | | | |
|---|---|---|---|
| 4,037,815 | 7/1977 | Delano | 84/327 |
| 4,566,365 | 1/1986 | Huston, Jr. | 84/317 |
| 4,742,751 | 5/1988 | Cherry | 84/327 |

*Primary Examiner*—Michael L. Gellner
*Assistant Examiner*—Patrick J. Stanzione
*Attorney, Agent, or Firm*—Ben E. Lofstedt

[57] ABSTRACT

A guitar holster for cradling the body of a guitar, including a generally T-shaped, rearwardly-facing element substantially co-extensive with the back side of the guitar, a forwardly-facing element essentially extending from the bottom of the guitar body up to the guitar strings' anchoring points and peripherally-disposed about the portion of the body of the guitar disposed therebetween, the peripheral portion of the forwardly-facing element secured to the complementary peripheral portion of the rearwardly-facing element to form a pocket for cradling or holstering the guitar body therein, means for securing the neck of the guitar to the vertical portion of the T-shaped element, and means for securing the entire combination of elements to a support structure, such as the housing for a guitar amplifier, or a speaker enclosure, or a wall, or the like.

7 Claims, 1 Drawing Sheet

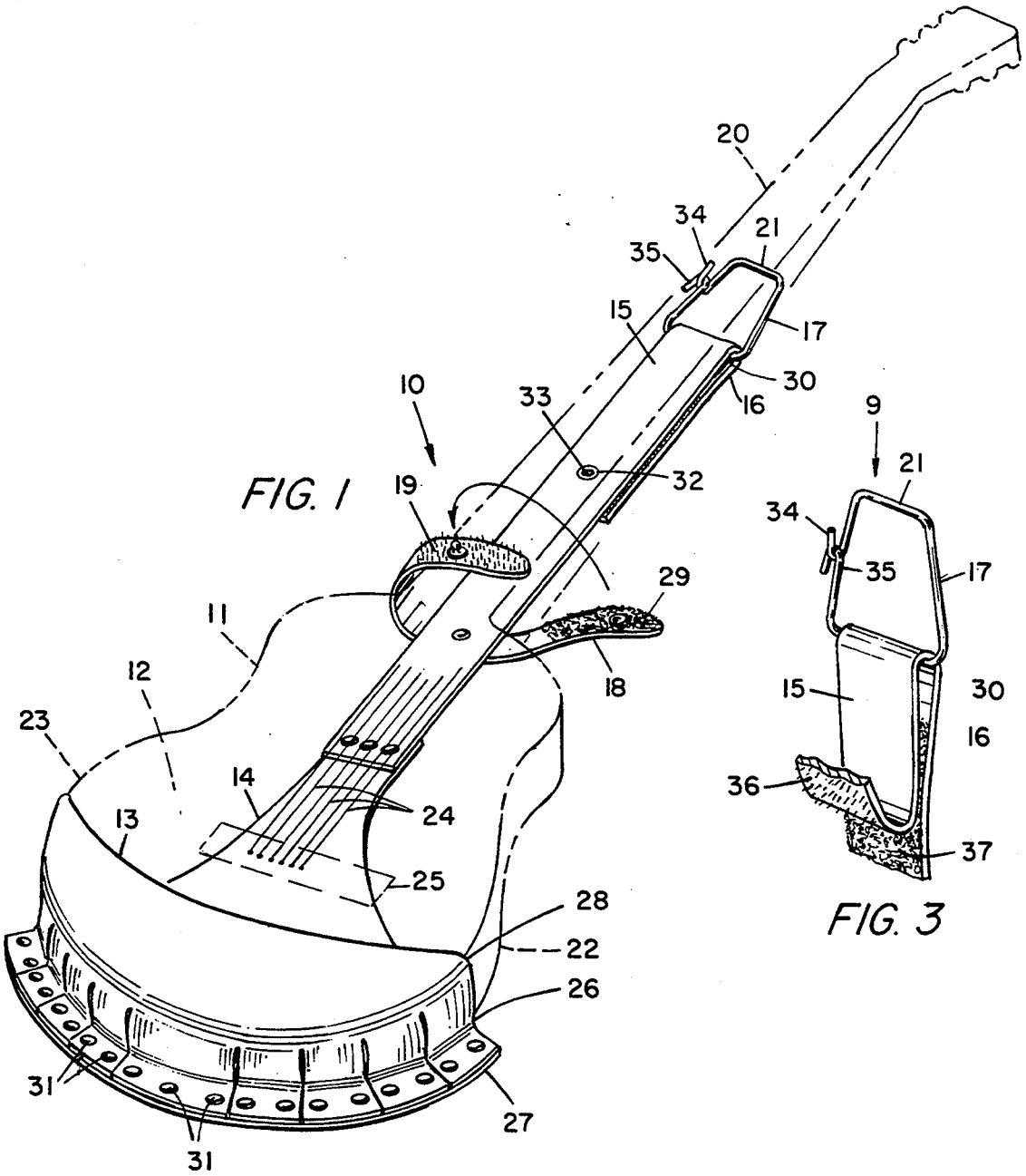
FIG. 1
FIG. 3
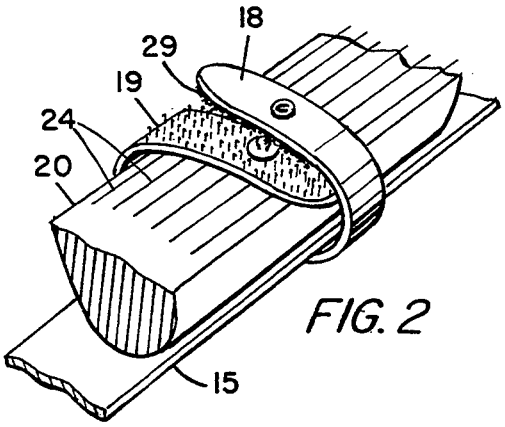
FIG. 2
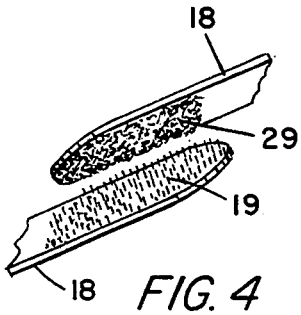
FIG. 4

GUITAR HOLSTER

BACKGROUND OF THE INVENTION

1. Field of the Invention

The present invention relates to guitar holders, and, more particularly, to a guitar holster for cradling the body of a guitar which is attachable to a speaker enclosure, a amplifier enclosure, a wall, or the like.

2. Background of the Invention

One of the most popular musical instruments is a guitar. Guitar music is played either solo, or with a band or as an accompaniment to vocals. Its versatility has made it a long-time favorite of country-western, rock and roll, and other types of music as well.

It is not unusual for a quality electric or acoustic guitar to cost over $1,000.00.

When a professional guitar player stops for a brief break or interlude between performances, or sets, he or she typically, has limited options as to the temporary storage or placement of his or her guitar. One of the options is to re-pack it in its carrying case, putting it on a self-standing guitar stand, or lean it against a speaker or amplifier enclosure or a wall. All of these options, with the exception of the guitar case, fail to protect the expensive guitar from being damaged due to being bumped, or kicked, or otherwise knocked over from its standing/lean-to position to the floor. If placed in such a temporary position, or on a stand, the likelihood of a guitar being damaged is highly likely because of the frenzied activity associated with modern "guitaring".

Modern "guitaring" has evolved, or devolved, to not only the musician engaging in extensive, frenzied activities, but, it is not unheard of for the musical minds of modern guitaring to smash, shatter and otherwise destroy even the guitar in such frenzied activities. Nevertheless, in most cases, the guitarist seeks to protect his musical treasure and tool by which he or she earns his or her livelihood at all costs. It is to this end that the present invention is directed.

By the use and application of the applicant's invention described in detail herein, the guitar player no longer has to worry about some "hyperschizoid" musician or "possessed" child maniac plunging his or her $1,200.00 plus, modern-day musical six-shooter into the netherworld of disrepair.

SUMMARY OF THE INVENTION AND OBJECTS

Fundamentally, the present invention is a guitar holster for safely holding the guitar in relatively protective fashion so that the guitar can be temporarily stored between musical performances by convenient attachment to a speaker or amplifier cabinet. To this end, there is described and shown herein a guitar holster for cradling the body of a guitar, including a generally T-shaped, rearwardly-facing element substantially co-extensive with the back side of the guitar, a forwardly-facing element essentially extending from the bottom of the guitar body up to the guitar strings' anchoring points and peripherally-disposed about the portion of the body of the guitar disposed therebetween, the peripheral portion of the forwardly-facing element secured to the complementary peripheral portion of the rearwardly-facing element to form a pocket for cradling or holstering the guitar body therein, means for securing the neck of the guitar to the vertical portion of the T-shaped element, and means for securing the entire combination of elements to a support structure, such as the housing for a guitar amplifier, or a speaker enclosure, or a wall, or the like.

It is one primary and important object of the instant invention to allow the guitar to be set or stored adjacent to an amplifier or speaker cabinet in such a fashion that the guitar cannot be easily bumped or knocked over onto the floor.

Another important and significant purpose of the invention is to provide an alternative means for temporarily and protectively storing the guitar, while the guitar is kept conveniently "at the ready" for rapid deployment into the next musical set at a moments' notice.

A yet still further, and important, object of the present invention is to provide a visually-pleasing and decorative holster for a guitar.

Another object of the invention is to provide a convenient means for compactly securing for storage, a guitar to a portable speaker or amplifier enclosure.

Other features and objects of the within invention will become more readily apparent as a further and more detailed description of the invention proceeds herein by virtue of the detailed drawings and a comprehensive description of one preferred embodiment of the invention is developed more fully herein afterwards.

BRIEF DESCRIPTION OF THE DRAWINGS

FIG. 1 is a overall perspective view of the invention disclosed herein.

FIG. 2 is an enlarged portion of the strap which secures the guitar neck to the guitar holster described as the invention herein.

FIG. 3 is an enlarged portion of the extreme end of the instant invention which acts as a fastening means for removably securing the guitar neck to the guitar holster.

FIG. 4 is an enlarged view of one of the embodiments of the fastening means portion of the present invention showing how the fastening tape, namely: Velcro tape, by which the neck of the guitar is secured to the invention disclosed herein.

DESCRIPTION OF THE PREFERRED EMBODIMENT

With continued references to all of the drawings herein, and with particular emphasis now on FIG. 1, there is shown a guitar holster, generally shown at 10, for cradling the body 11 of a guitar 12, including a generally T-shaped, rearwardly-facing element 14 substantially co-extensive with the back side 22 of the guitar 12, a forwardly-facing element 13 essentially extending from the bottom 22 of the guitar 12 body 11 to below the guitar strings' 24 anchoring point 25 and peripherally-disposed about the portion of the body 11 of the guitar 12 disposed therebetween, the peripheral portion 26 of the forwardly-facing element 13 secured to the complementary peripheral portion 27 of the rearwardly-facing element 14 to form a pocket 28 for cradling or holstering the guitar body 11 therein.

With additional special emphasis on both FIGS. 1 and 2, the neck 20 of the guitar 12 is removably secured to the vertical portion 15 of the T-shaped element 14 via a strap 18 with complementary Velcro tapes 19 and 29. This keeps the guitar body 11 from falling out of, or disengaging from, the pocket 28 of the guitar holster 10, yet conveniently allows for rapid engagement and disengagement of the guitar 12 in and out of the guitar holster 10.

A wire-frame 17 loop 21 is engaged with a loop 30 formed when the end 15 of the T-shaped element 14 is turned back upon itself at 16 and, typically, riveted to the element 14. The rivet 32 has a hole 33 therethrough to allow it to be secured to a wall (not shown) by means of a toggle bolt, a screw, or a Molly bolt. The wire-frame 17 has a clasp mechanism, generally indicated at 9, which has two (2) complementary hooks 34, 35 which are removably engageable to allow the loop 21 to be engaged with the manual carrying handle portion of a speaker or amplifier enclosure allowing the guitar 12 in the guitar holster 10 to be disposed alongside the enclosure and disposed in intimate juxtaposition thereto.

With special emphasis now on FIG. 3, there is shown and illustrated and alternate form of one portion of the present invention which provides a means for adjusting the length of the T-shaped element 14 (the rivet 32 is not used in this configuration) to the element 14 when it is turned back upon itself at 16 by the use of velcro hook 36 and pile 37 arrangement.

Various other modifications will readily occur to those skilled in the art to which this pertains without departing from the spirit or scope of the invention herein. For example, while there is shown in the preferred embodiment of the invention herein which is constructed from sheets of leather material, other materials, such as injection-molded plastics, cloth, wood, metal, and the like, could readily be used and adapted for the construction of the present invention herein. Further, the vertical portion, ie the same as the end 15 of the T-shaped element 14, is not required to be T-shaped, it could just as easily be rectangular in shape, extending far beyond the lateral dimensions of the neck 20 of the guitar 12, without departing from the invention herein. Additionally, while the preferred embodiment disclosed herein uses a series of rivets 31 to join the peripheral portion of the forwardly-facing element 13 and the rearwardly-facing element 14 together as shown in FIG. 1 to form the pocket 28 of the guitar holster 10. Still further, it should be obvious to those skilled in the art to which this invention pertains, that various other methods for joining such can be used without departing from the scope of the present invention. Gluing, sewing, or even the use of a single piece of material could readily, with equal usefulness, be employed to form the pocket 28 for the guitar holster 10. With this in mind, it is therefore intended that the scope of the invention be determined solely on the claims appended hereto.

I claim:

1. A guitar holster for holding the body of a guitar, comprising:

(a) a rearwardly-facing element disposed in intimate relationship with the back side of the guitar;

(b) a forwardly-facing element extending from the bottom of the guitar body up to the guitar strings' anchoring points and peripherally-disposed about the portion of the body of the guitar disposed therebetween, the peripheral portion of the forwardly-facing element being secured to the complementary peripheral portion of the rearwardly-facing element to form a pocket for holstering both sides of the bottom portion of the guitar body therein up to the mediate portion thereof;

(c) means for securing the neck of the guitar to the rearwardly-facing element; and (d) means for securing the entire combination of elements to a support structure, such as the housing for a guitar amplifier, or a speaker enclosure, or a wall.

2. The guitar holster of claim 1, wherein a rearwardly-facing element disposed in intimate relationship with the back side of the guitar is T-shaped.

3. The guitar holster of claim 1, wherein the rearwardly-facing element and the forwardly-facing element are each constructed of sheets of leather.

4. The guitar holster of claim 1, wherein the peripheral joining the rearwardly-facing element and the forwardly-facing element by rivets.

5. The guitar holster of claim 1, wherein the means for securing the entire combination of elements to a support structure, such as the housing for a guitar amplifier, or a speaker enclosure, or a wall, comprises a wire loop interconnected with a loop formed in the end of the rearwardly-facing element.

6. The guitar holster of claim 1, wherein the means for securing the neck of the guitar to the rearwardly-facing element comprising a strap with a pair of Velcro tape fastening elements.

7. A guitar holster for holding the body of a guitar, comprising:

(a) a rearwardly-facing, T-shaped element disposed in intimate relationship with the back side of the guitar, wherein the rearwardly-facing element is formed from a sheet of leather;

(b) a forwardly-facing element constructed from a sheet of leather, and extending from the bottom of the guitar body up to the guitar strings' anchoring points and peripherally-disposed about the portion of the body of the guitar disposed therebetween, the peripheral portion of the forwardly-facing element being secured to the complementary peripheral portion of the rearwardly-facing element to form a pocket for holstering the guitar body therein;

(c) means for securing the neck of the guitar to the rearwardly-facing element; and (d) means for securing the entire combination of elements to a support structure.

* * * * *